US006733276B1

(12) United States Patent
Kopping

(10) Patent No.: US 6,733,276 B1
(45) Date of Patent: May 11, 2004

(54) GAS SHUT-OFF DEVICE

(76) Inventor: Jeffrey R. Kopping, 14 Sycamore La., Commack, NY (US) 11725

( * ) Notice: Subject to any disclaimer, the term of this patent is extended or adjusted under 35 U.S.C. 154(b) by 0 days.

(21) Appl. No.: 10/377,675

(22) Filed: Mar. 4, 2003

(51) Int. Cl.[7] ..... F23N 5/22
(52) U.S. Cl. ..... 431/86; 222/639.3; 137/624.11
(58) Field of Search ..... 431/86, 87; 137/552.7, 137/624.11; 222/639

(56) References Cited

U.S. PATENT DOCUMENTS

| | | | | | |
|---|---|---|---|---|---|
| 2,772,067 | A | * | 11/1956 | Wilson | 251/229 |
| 4,179,373 | A | | 12/1979 | Sablich et al. | |
| 4,242,080 | A | | 12/1980 | Tabei | |
| 4,298,024 | A | | 11/1981 | McLeod | |
| 4,543,974 | A | | 10/1985 | Dietiker et al. | |
| 4,823,838 | A | * | 4/1989 | Ferlin | 137/624.12 |
| 4,836,247 | A | * | 6/1989 | Chuang | 137/624.12 |
| 4,850,852 | A | | 7/1989 | Ballard | |
| 4,866,633 | A | | 9/1989 | Nakane et al. | |
| 4,974,624 | A | | 12/1990 | Gotanda | |
| 5,094,259 | A | | 3/1992 | Hsu | |
| 5,203,688 | A | | 4/1993 | Dietiker | |
| 5,287,048 | A | | 2/1994 | Lakin et al. | |
| 5,551,474 | A | * | 9/1996 | Chuang et al. | 137/495 |
| 5,628,242 | A | | 5/1997 | Higley | |
| 5,722,448 | A | | 3/1998 | Dourado | |
| 5,979,867 | A | | 11/1999 | Ortiz Godinez | |
| 6,000,931 | A | | 12/1999 | Tanabe et al. | |
| 6,059,562 | A | | 5/2000 | Anderson, II | |
| 6,082,388 | A | | 7/2000 | Turrin et al. | |
| 6,112,764 | A | | 9/2000 | Engdahl et al. | |
| 6,164,319 | A | | 12/2000 | Cochran et al. | |
| 6,170,509 | B1 | | 1/2001 | Karta | |
| 6,192,913 | B1 | | 2/2001 | Willey et al. | |
| 6,199,573 | B1 | | 3/2001 | Paskiewicz | |
| 6,234,189 | B1 | | 5/2001 | Koch | |
| 6,263,908 | B1 | | 7/2001 | Love et al. | |
| 2002/0124883 | A1 | | 9/2002 | Zheng et al. | |

FOREIGN PATENT DOCUMENTS

| | | | | |
|---|---|---|---|---|
| DE | 3835497 A1 | | 4/1990 | |
| EP | 0 091 329 | | 10/1984 | |
| GB | 2058297 A | | 4/1981 | |
| GB | 2131942 A | * | 6/1984 | F23N/5/22 |
| JP | 56-42774 A | | 4/1981 | |

OTHER PUBLICATIONS www.fossil.ca/fuelhandling/gasvalves.asp is a website for Fossil, a company that provides system hardware services for steam power and other industries.

* cited by examiner

*Primary Examiner*—Ira S. Lazarus
*Assistant Examiner*—James G. Barrow
(74) *Attorney, Agent, or Firm*—Richard C. Litman

(57) ABSTRACT

A gas shut-off device is provided to automatically cut off gas supply to a gas appliance, such as an outdoor gas fueled barbecue grill, at the expiration of a predetermined time period thereby saving gas and preventing hazards usually associated with a grill that has been left on after use. The gas shut-off device of the present invention is tamper resistant thereby-reducing the risk of a child inadvertently directing gas to an unlit appliance.

8 Claims, 9 Drawing Sheets

GAS SHUT-OFF DEVICE

BACKGROUND OF THE INVENTION

1. Field of the Invention

The present invention relates to a tamper resistant, safety promoting, and gas saving gas shut-off device. More specifically, the invention is directed to a tamper resistant device that automatically shuts-off a gas supply to a gas fueled appliance such as a barbeque grill at the expiration of a predetermined time period.

2. Description of the Related Art

Gas cooking devices are well known and include such devices as outdoor cook-top or barbeque (BBQ) grills, motor home gas stoves, etc. Problems can arise, for example, when an outdoor gas fueled cook-top or BBQ grill is not switched off after use.

Forgetting to turn off a grill raises both safety and cost issues. Also, a child could play with a grill's controls and accidently turn the gas supply to the grill on. Thus, there is a need for a tamper resistant device that automatically shuts-off a gas supply after a desired cooking time.

Several efforts have been made to address these problems.

U.S. Pat. No. 6,234,189 B1 issued May 22, 2001 to J. Koch describes a gas valve with a thermoelectric safety shut-off feature. The '189 device requires an electricity supply to operate a controller and a solenoid, i.e. the '189 device can not be set by a user to shut off after a desired time using a mechanical timer.

U.S. Pat. No. 5,628,242 issued May 13, 1997 to J. E. Higley, describes a gas grill with an automatic shut-off valve, which is controlled by a dynamic activity sensor. The '242 patent describes an activity monitor for a gas cooker or grill which monitors activity with a motion detector to avoid fire hazard and/or wasting of fuel. The '242 device describes an adjustable timer to activate an automatic gas shut-off device to cut-off gas supply after no motion has been detected for a preselected time period. The '242 patent describes an adjustable time controlled valve, which can be turned on merely by turning a knob. A child could therefore inadvertently turn on the gas supply simply by turning a knob.

U.S. Pat. No. 5,722,448 issued Mar. 3, 1998 to M. F. Dourado describes a gas line automatic shut-off valve. The '448 device is directed to problems which result from device malfunctions including gas leaks and smoke from a fire.

Therefore, the '448 device does not address the avoidance of problems which are caused by grills that are functioning correctly, but may cause problems when inadvertently left on by the user.

Other patents showing gas shut-off devices, but which do not suggest a gas shut-off device according to the claimed invention, include U.S. Pat. No. 4,179,373 (Sablich et al.), U.S. Pat. No. 4,242,080 (Tabei), U.S. Pat. No. 4,298,024 (McLeod), U.S. Pat. No. 4,543,974 (Dietiker et al.), U.S. Pat. No. 4,850,852 (Ballard), U.S. Pat. No. 4,866,633 (Nakane et al.), U.S. Pat. No. 4,974,624 (Gotanda), U.S. Pat. No. 5,203,688 (Dietiker), U.S. Pat. No. 5,287,048 (Lakin et al.), U.S. Pat. No. 5,979,867 (Ortiz Godinez), U.S. Pat. No. 6,000,931 (Tanabe et al.), U.S. Pat. No. 6,059,562 (Anderson, II), U.S. Pat. No. 6,082,388 (Turrin et al.), U.S. Pat. No. 6,112,764 (Engdahl et al.), U.S. Pat. No. 6,164,319 (Cochran et al.), U.S. Pat. No. 6,170,509B1 (Karta), U.S. Pat. No. 6,192,913B1 (Willey et al.), U.S. Pat. No. 6,199,573B1 (Paskiewicz), U.S. Pat. No. 6,263,908B1 (Love et al.), and Published U.S. application Ser. No. 2002/0124883 (Zheng et al).

Foreign patents showing gas shut-off devices, but which do not suggest a gas shut-off device according to the claimed invention, include Japanese Patent No. 56-42774-A, United Kingdom Patent No. GB 2058297A, European Patent No. EP 0091329, and German Patent No. DE3835497A1.

None of the above inventions and patents, taken either singly or in combination, is seen to describe the instant invention as claimed. Thus a user set and child resistant automatic gas shut-off device solving the aforementioned problems is desired.

SUMMARY OF THE INVENTION

The present invention is directed to a gas shut-off device to automatically cut off gas supply to a gas appliance, such as an outdoor gas fueled barbecue grill, at the expiration of a predetermined time period thereby saving gas and preventing hazards usually associated with a grill that has been left on after use. The gas shut-off device of the present invention is tamper resistant thereby reducing the risk of a child inadvertently directing gas to an unlit appliance.

Accordingly, it is an object of the invention to provide a gas shut-off device that stops gas flow to a gas fueled device which has been inadvertently left on after use.

It is a further object of the invention to provide a gas shut-off device that stops gas flow to a gas fueled device after a predetermined time period set by a user.

It is another object of the invention to provide a gas shut-off device that is resistant to tampering by a child.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a tamper resistant, safety promoting, and gas saving gas shut-off device 50, shown in FIGS. 1–4C, to automatically cut off gas supply to a gas fueled appliance ("gas appliance"), such as an outdoor gas fueled barbecue grill 60, at the expiration of a predetermined time period thereby saving gas and preventing hazards associated with a gas appliance that has been left on after use.

Figure 4A:
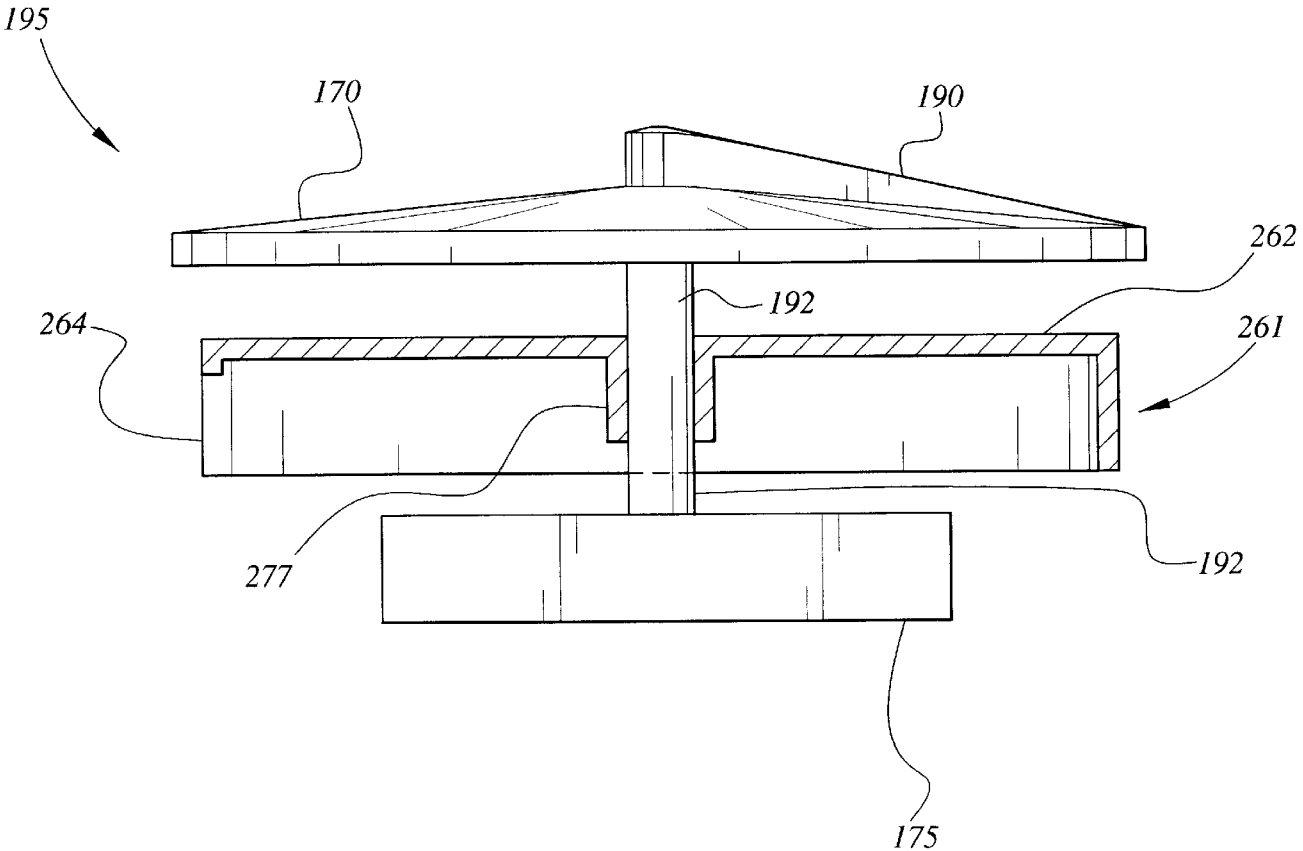
FIG. 4A is a side view of a timer-lever control mechanism of the gas shut-off device according to one embodiment of the present invention.

Referring generally to FIGS. 1, 2A, 2B and 2C, a tamper resistant, safety promoting, and gas saving gas shut-off device 50 ("gas shut-off device 50") is provided to selectively shut off a flow of gas, such as liquid petroleum gas or natural gas, to a gas fueled device, such as a BBQ grill 60, in response to a user 65 selected time period entered via a timer-lever control mechanism 195 (see e.g. FIG. 4A).

The gas shut-off device 50 comprises a housing 110 having a gas passage 160 with a first opposite end 162 (see FIG. 2B) defining a gas inlet port 120 for inputting gas from a gas supply (such as a liquid petroleum gas or natural gas supply) and a second opposite end 164 defining a gas outlet port 130 to supply gas to e.g. a gas hose 100 attached to a grill 60.

A lever operated gas shut-off valve 230 having an open position and a closed position is located between the gas inlet 120 and gas outlet 130. A lever 240 with a first 250 and a second 260 opposite end; the first opposite end 250 is operably connected to the lever controlled gas shut-off valve 230, and the second opposite end 260 is operably connected to the timer cup 261. The lever 240 has a lever-up and a lever-down position for, controlling the open and closing of the lever operated gas shut-off valve 230.

The internal structure of the lever controlled gas shut-off valve 230 is not shown since numerous internal or in line lever-controlled valve structures for opening and closing off fluid passage are already known in the art and the present invention is adapted to, and provides for, the improvement of the use of all such valves. A non-limiting example of a lever-controlled gas valve 230 is a zinc alloy lever-controlled valve available as part number 6852K11 from McMaster-Carr Supply Company (catalogue number 108). McMaster-Carr Supply Company has numerous locations including a business address at New Brunswick, N.J. PO Box 440, 08903 (telephone: 732-329-3200, 732-329-3772; e-mail:

nj.sales@mcmaster.com).

Still referring generally to FIGS. 1, 2A, 2B and 2C, a, timer-lever control mechanism 195 is operably connected to the lever 240, wherein the timer-lever control mechanism 195 is adapted to allow a user 65 to input a predetermined time interval, wherein the timer-lever control mechanism 195 is operably connected to the second end 260 of the lever 240, and, wherein the timer-lever control mechanism 195 is adapted to control the up and down status of the lever 240. A button 210 is operably connected to the lever 240, wherein the button 210 has a default position and in response to a force can be moved to a non-default position. Continuous gas flow (shown by arrows 282) along the passage 160 is possible if a predetermined time interval is entered into the timer-lever control mechanism 195 (FIG. 4A) while the button 210 is held in the non-default position to provide the tamper resistant, safety promoting, and gas saving gas shut-off device 50.

Figure 1:
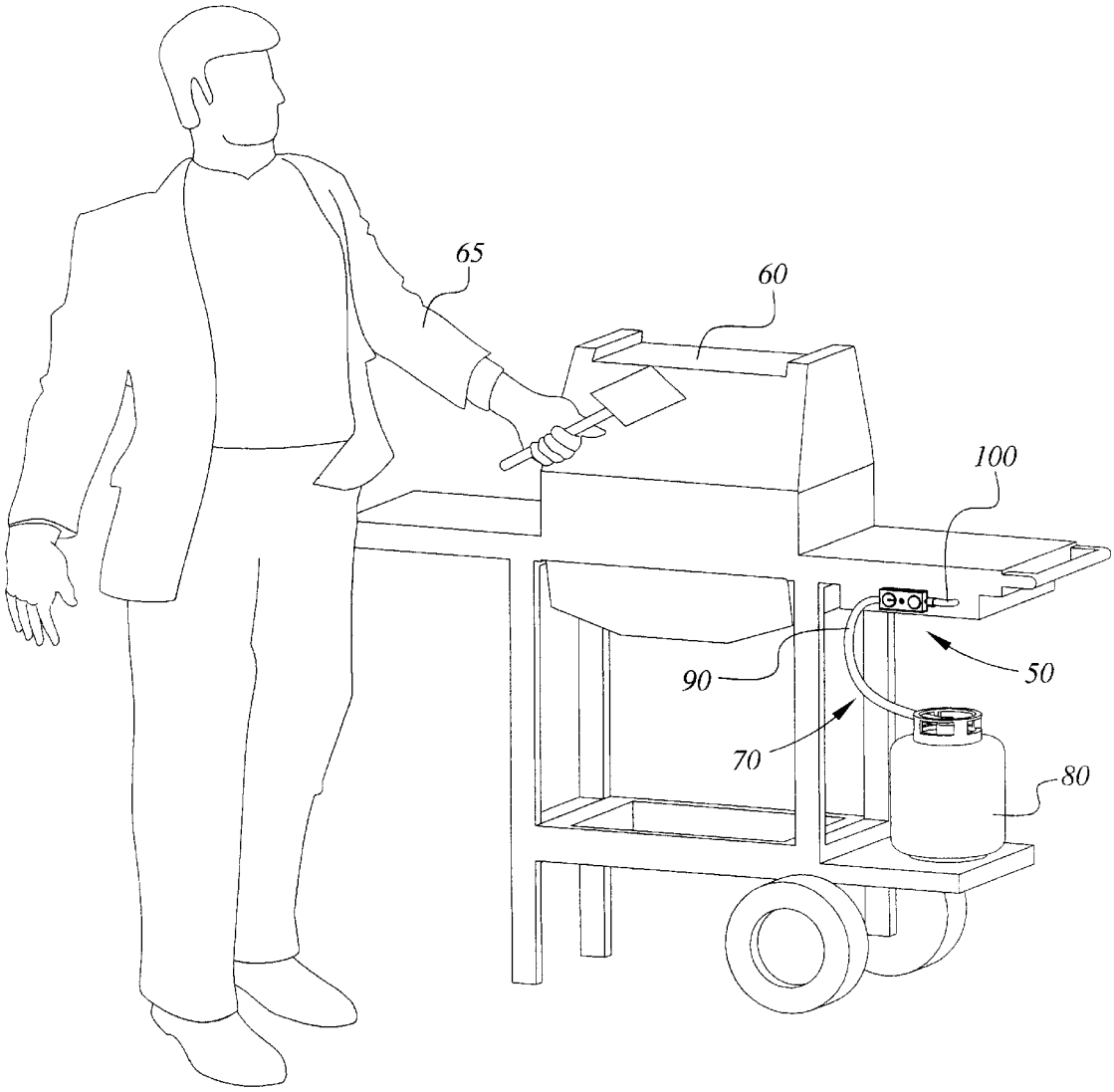
FIG. 1 is an environmental, perspective view of a gas shut-off device according to one embodiment of the present invention.

Referring to FIGS. 1, 2A, 2B and 2C in more detail, FIG. 1 shows an environmental perspective view of the gas shut-off device 50 of the invention. The gas shut-off device 50 is shown fitted to a BBQ grill 60. The gas shut-off device 50 is located in a fuel path 70 between a gas tank 80 and the grill 60. The fuel path 70 comprises a first section of gas supply hose 90 between the gas tank 80 and gas shut-off device 50, and a second section of gas hose 100 between the gas shut-off device 50 and the grill 60. The gas tank 80 is typically a standard container of gas such as LPG (liquid petroleum gas). Different types of gas tank 80 are well known in the art and will not be discussed further here. The gas shut-off device 50 can also be connected between an appliance such as the grill 60 and a gas hose connected to a constant gas supply such as a house-hold gas supply (not shown).

Figure 2A:
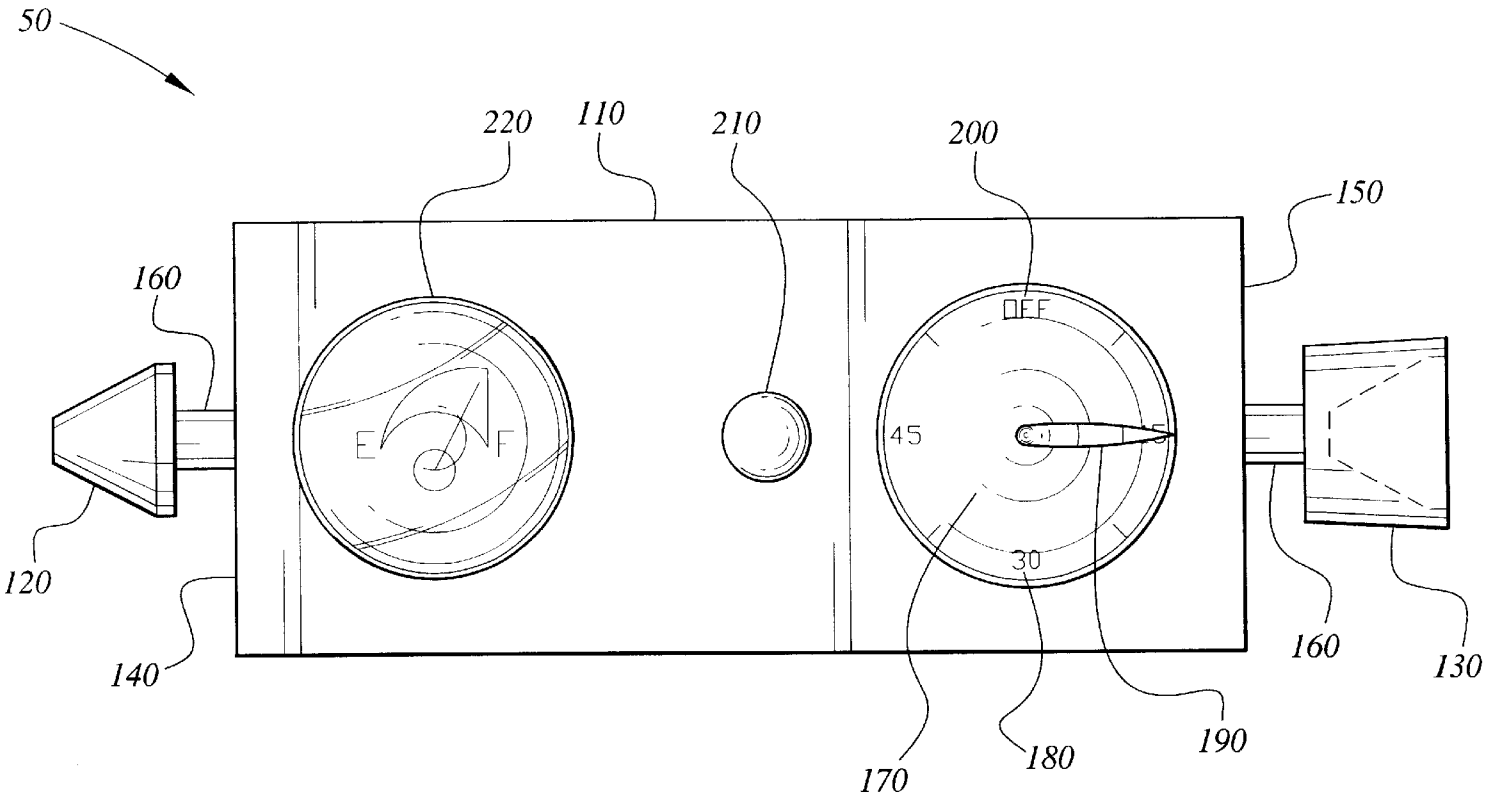
FIG. 2A is a top view of the gas shut-off device of FIG. 1.

FIG. 2A shows a top external view of the preferred embodiment of the invention wherein the gas shut-off device 50 comprises a housing 110 with a standard gas inlet 120 and gas outlet 130 ports at opposite ends 140 and 150, respectively, of the housing 110. Partly hidden from view is a gas flow passage 160 between the gas inlet and outlet ports 120 and 130, respectively. Protruding from the housing 110 is a timer face, 170 marked up with number indicia 180. The timer face 170 includes a timer knob 190. A timer knob 190 sits atop an axle 192 (see FIG. 2B) and can be rotated to different positions with respect to the timer face 170 and number indicia 180.

Figure 2B:
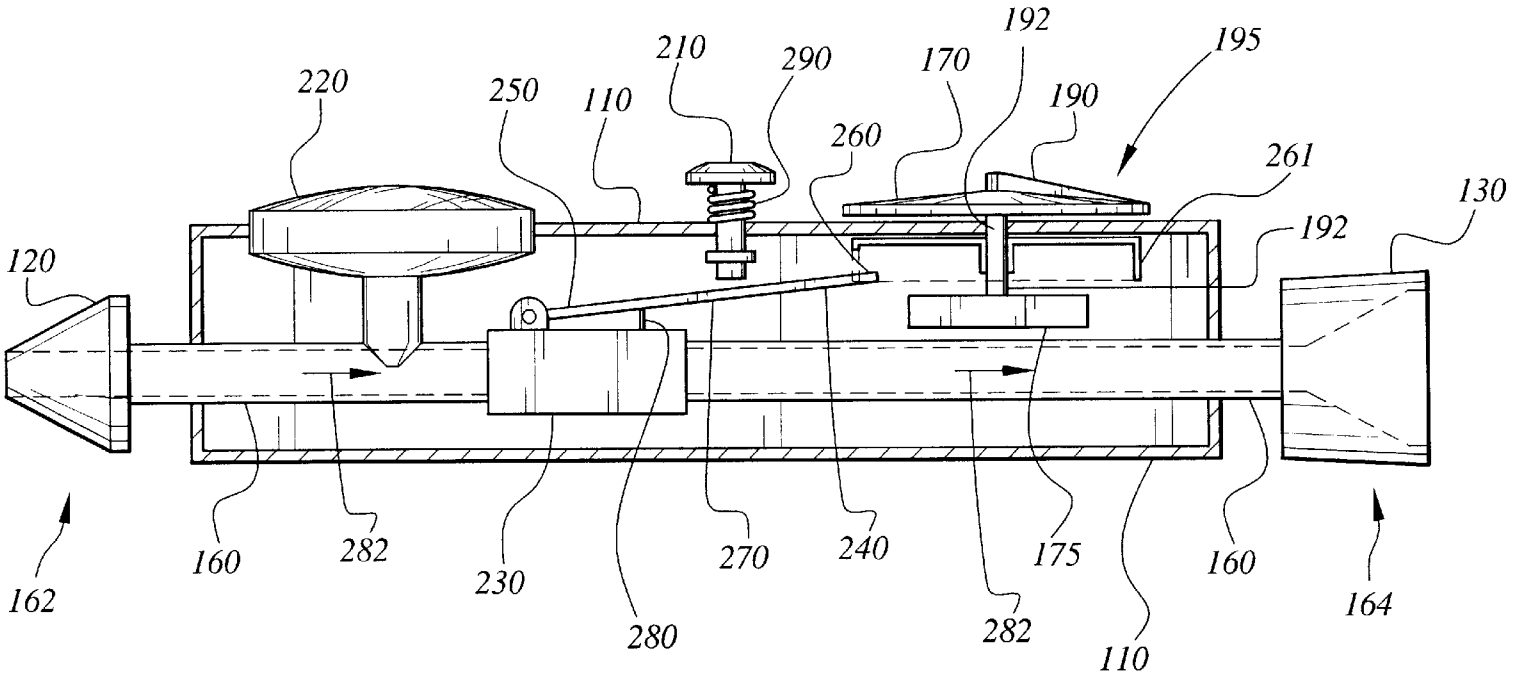
FIG. 2B is an interior view of the gas shut-off device of FIG. 2A.

FIG. 2B shows an internal view of the preferred embodiment of the invention wherein a timer knob 190 is operably connected, by means of axle 192, to an internal spring (not shown) located in a spring housing 175; the housing 175 is preferably connected to the main housing 110 to ensure that the axle 192 can move independently of the spring housing 175. The axle 192 is connected to a timer cup 261 and timer knob 190 such that as the axle 192 rotates then the timer knob 190 and the timer cup 261 rotate in unison with the axle 192. The timer face 170, timer knob 190, axle 192, timer cup 261, and timer spring housing 175 are members of the timer-lever control mechanism 195 of the gas shut-off device 50. Mechanical spring driven timers are well known in the clock art.

It should be understood that the temrs "cooking time", "selected time", "user selected time period", and "predetermined time" are herein regarded as equivalent terms. For example, in the preferred embodiment a user selected time period of 30 minutes is selected by a person 65 turning the timer knob 190 from the off position 200 to the 30 minute mark on the timer face 170.

In the preferred embodiment, the timer knob 190 is rotated by the fingers of a person's hand from the off position 200 to a desired cooking time as represented by the numeric indicia 180 on the timer face 170. As the timer nob 190 is rotated so the axle 192 and timer cup 261 rotates in unison with the timer knob 190. The timer knob 190 slowly returns to the off position 200 by action of an internal spring in the spring housing 175 acting on axle 192 connected to the timer cup 261 and the timer knob 190.

In another preferred embodiment the timer face 170 remains in a fixed position while the knob 190 is rotated from the off position 200 to the desired cooking time position represented by the numeric indicia 180 on the timer face 170. The timer knob 190 is connected to the timer cup 261 via the axle 192 so that the timer cup 261 is rotated in unison with the timer knob 190. The timer face 170 can be kept in a fixed position by connecting the timer face 170 to the housing 110.

In an alternative embodiment, a person selects a predetermined time by turning the face 170 which rotates relatives to the timer knob 190,i.e. the face 170 is operably conneted to the timer cup 261 via axle 192 and the timer knob 190 remains in a fixed position. The timer knob 190 can be kept in a fixed position, for example, by fastening the timer knob 190 to the housing 110 and disconnecting the timer knob 190 from the axle 192.

Regardless of whether the face 170 or timer knob are kept in a fixed position, the timer cup 261 is returned to a pre-rotate position by means of the timer spring mechanism in housing 175.

An optional gas pressure gauge 220 is shown, for example, in FIG. 2A. The optional gas pressure gauge 220 is preferably calibrated to indicate the amount of gas fuel left in the gas tank 80. The optional gas pressure gauge 220 is not required, for example, if the inlet gas port 120 of the gas shut-off device 50 is connected to a constant pressure gas supply such as a house-hold gas supply (not shown).

It should be understood that the inlet and outlet ports 120 and 130, respectively, may individually or separately take the form of a female or male connector. While the inlet port 120 is shown, for example, in FIG. 2A as a male connector designed to connect to the female end of a gas hose, the inlet 120 may take the form of a male connector. Likewise, while the outlet port 130 is shown, for example, in FIG. 2A as a female connector designed to connect to a complementary male connector, the outlet 130 may take the form of a male connector adapted to connect to a complementary female connector. Thus, the exact form of the inlet and outlet gas ports 120 and 130, respectively, may vary without detracting from the spirit of the present invention.

Figure 3A:
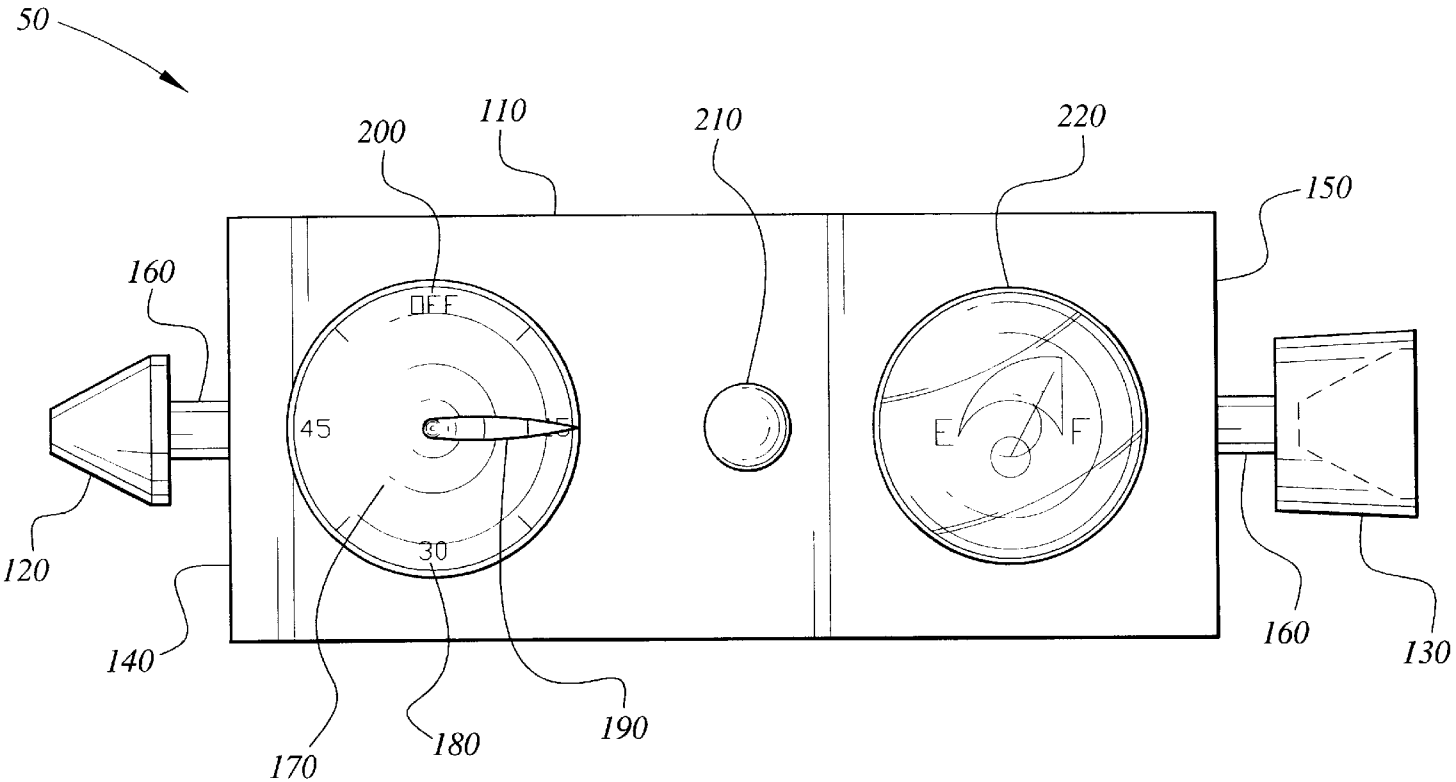
FIG. 3A is a top view of the gas shut-off device according to a further embodiment of the invention.
Figure 3B:
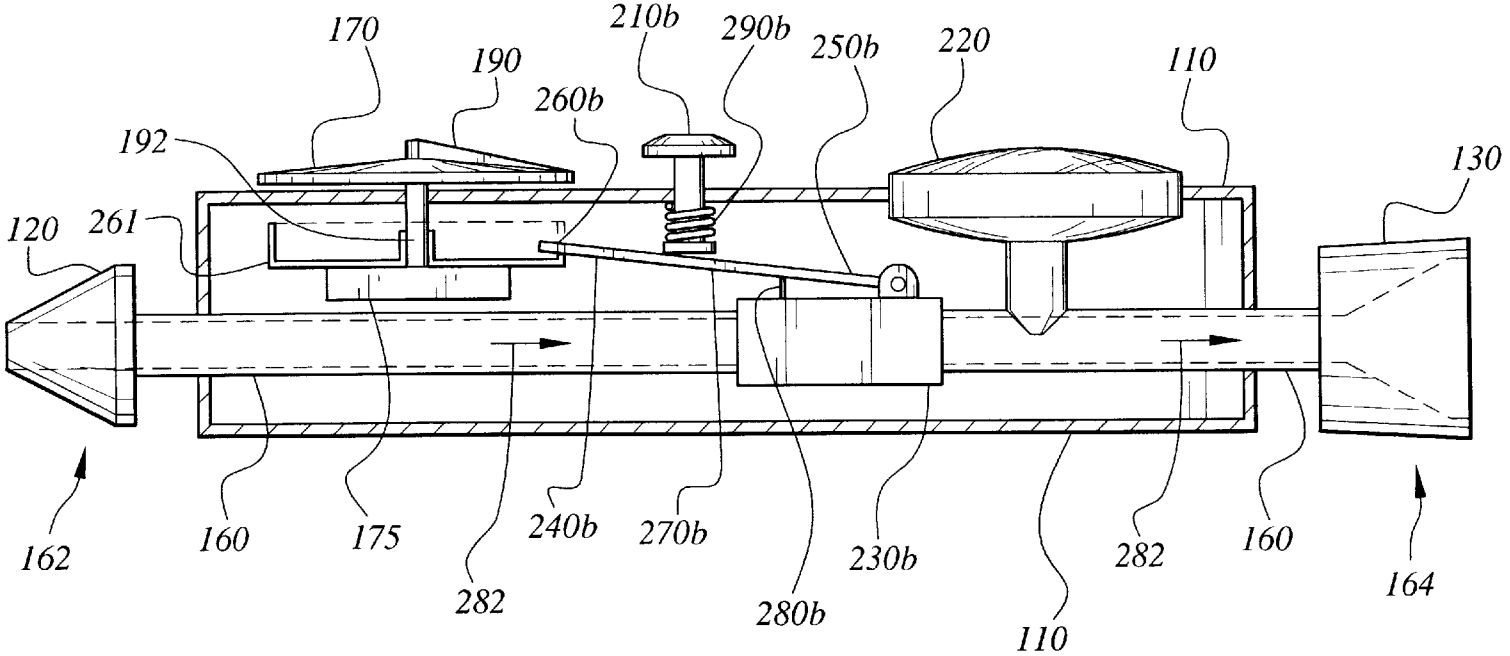
FIG. 3B is an interior view of the gas shut-off device of FIG. 3A.

The exact order and arrangement of the gauge 220, button 210, timer-lever control mechanism 195, and the lever operated shut-off valve 230 may vary. For example, the gauge 220 may occupy a position either upstream (e.g. see FIGS. 2A and 2B) or downstream (e.g. see FIGS. 3A and 3B) of the lever operated gas shut-off valve 230 (as shown in FIGS. 2B) or 230*b* (as shown in FIG. 3B), button 210 (FIG. 2B) or 210*b* (as shown in FIG. 3B), or the timer-lever control mechanism 195 (see e.g., FIG. 4A).

Figure 2C:
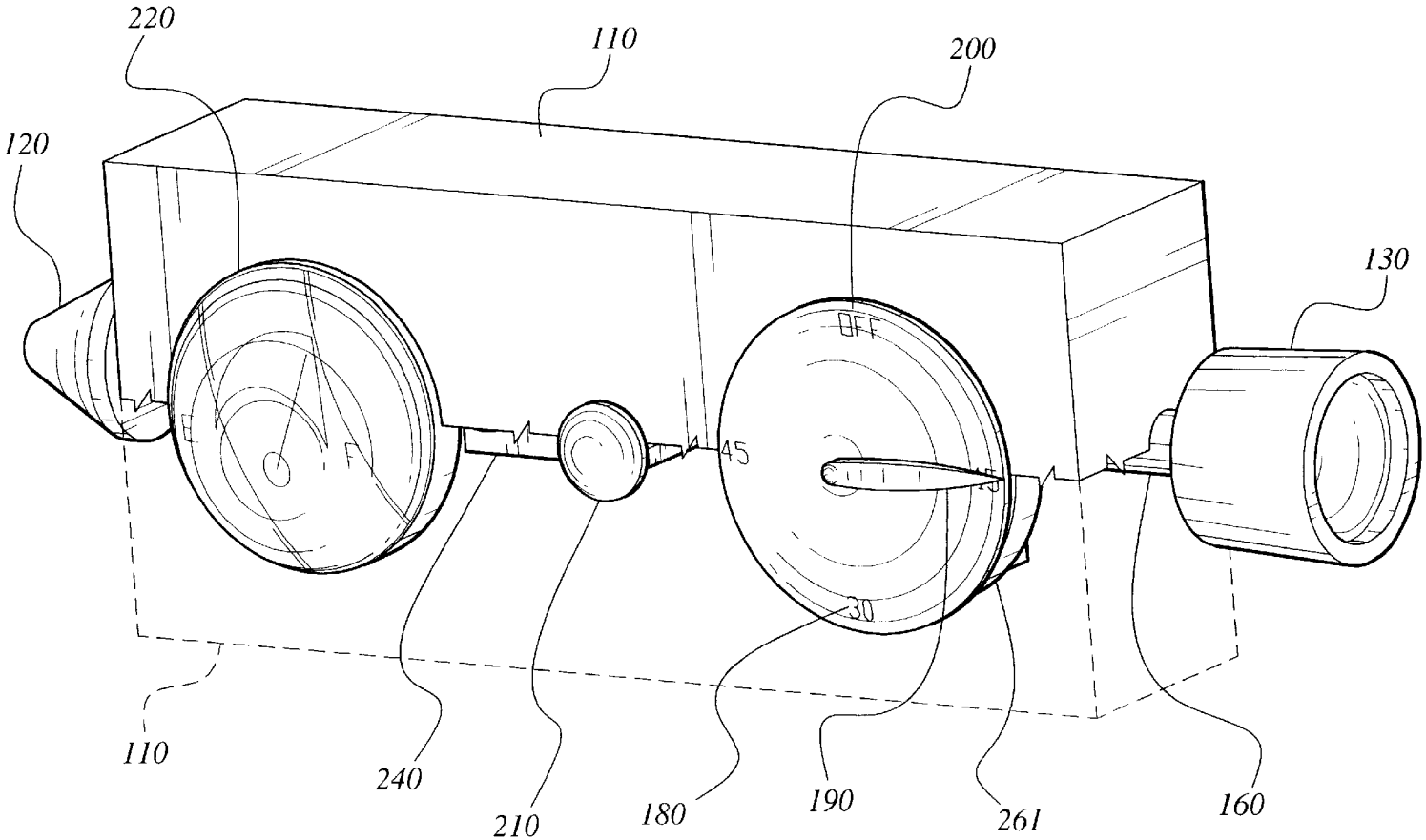
FIG. 2C is a perspective view of a gas shut-off device of FIG. 2A with the housing of the gas shut-off device partially cut away.

In FIGS. 2B and 2C, the gas pressure gauge 220 is shown upstream of the in-line lever operated gas shut-off valve 230; in this configuration the gas pressure gauge 220 would read the gas pressure in gas tank 80. Thus, a user 65 would be able to read the gas pressure from the gauge 220 even if the shut-off valve 230 is closed. However, if fitted, the gauge 220 can be located downstream of the in-line shut-off valve 230*b* as shown in FIGS. 3A and 3B; in this arrangement the optional gas pressure gauge 220 would not display the gas pressure in tank 80 (see FIG. 1) unless the in-line shut-off valve 230*b* was open; thus, in this configuration the optional pressure gauge 220 could be used to check the effectiveness of the gas valve 230*b*, e.g. if the gas shut-off valve 230*b* is leaking gas when closed, the gauge 220 would give a warning by registering a pressure in the passage 160 thus indicating the shut-off valve 230*b* is not properly closing off gas flow in the gas passage 160.

Still referring to FIGS. 2A, 2B, and 2C, the lever controlled gas valve 230 comprises a lever bar 240. The lever bar 240 has a first 250 and second opposite end 260 defining a middle section 270 of the bar 240. The first opposite end 250 is operably connected to the gas valve 230, and the second opposite end 260 is in contact with a timer cup 261, which is shown in FIG. 2B in an inverted orientation. However, the timer cup 261, can be used in different orientations including a non-inverted orientation as shown in FIG. 3B.

Figure 4B:
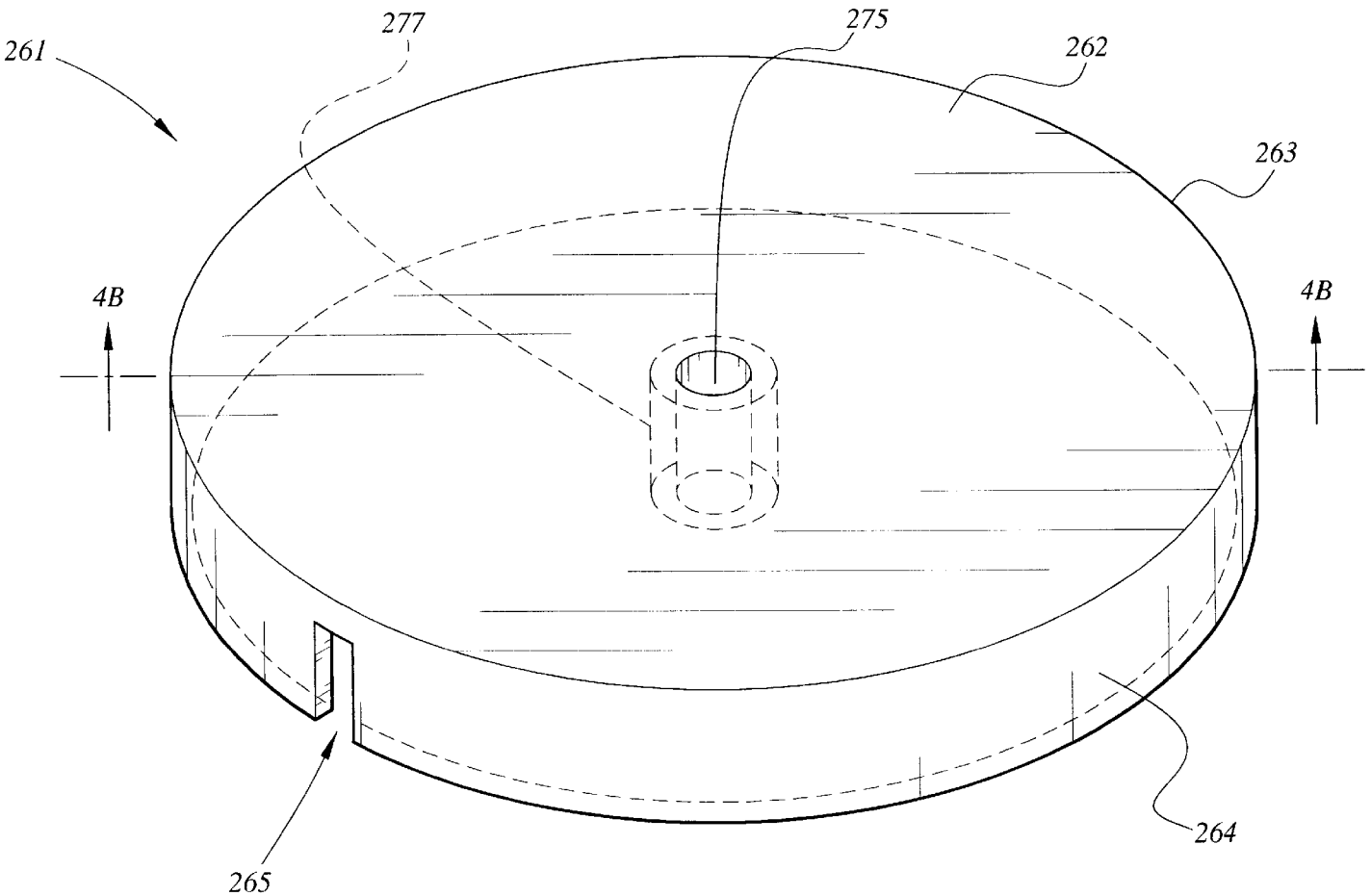
FIG. 4B is a perspective view of a component of a timer cup according to the present invention.
Figure 4C:
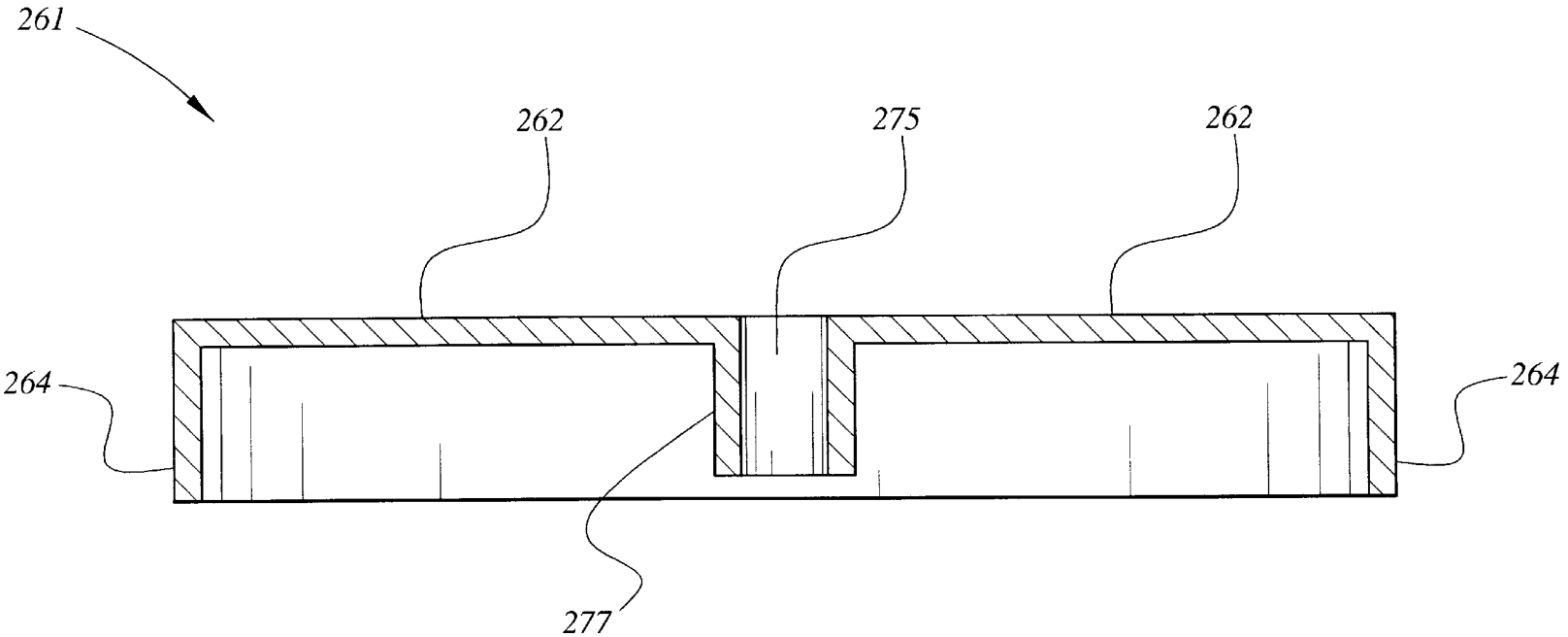
FIG. 4C is a cross-sectional view of the timer cup of FIG. 4B.

The timer cup 261 comprises a disc 262 with a circumference 263 and a rim 264 developed from the circumference 263 (see FIGS. 4B and 4C). The center of the disc 262 defines a through-hole 275 with an optional hollow tube 277 developed therefrom and affixed to axle 192 such that if the axle 192 rotates, the timer cup 261 rotates in unison. The rim 264 includes an indentation shown as a notch 265 as shown in FIG. 4B. It should be understood that the form of connection between the timer cup 261 and the axle member 192 of the timer-lever control mechanism 195 may vary without detracting from the spirit and scope of the invention, as defined by the appended claims.

The notch 265 is adapted to accommodate the second opposite end 260 of the lever bar 240. When the timer knob 190 is set to the off position 200 the second opposite end 260 is normally located in the notch 265. In this position, the lever 240 is in its default up position thereby ensuring the gas shut-off valve 230 is in its default gas shut-off mode thereby stopping any gas flowing along the passage 160 in the direction of the gas outlet port 130. In this embodiment, a spring 280 biases the lever 240 in the up or default position thereby maintaining the gas valve 230 in a closed position stopping gas flowing along the gas passage 160.

The lever end 260 rests against the rim 264 thereby maintaining the gas shut-off valve 230 (or its alternative form 230*b* as shown in FIG. 3B) in an open position to allow gas to flow along the passage 160. When the lever end 260 occupies the notch 265, the gas shut-off valve 230 or 230*b* is closed and gas is not allowed to flow along the passage 160.

Pressure applied to the button 210 is transmitted to the lever 240 which is pushed down thereby opening the gas shut-off valve 230 allowing gas to flow through the passage 160; arrows 282 indicate the direction of gas flow in passage 160 when the shut-off valve 230 is in the open position. A button spring 290 keeps the button 210 in a default up position relative to housing 110 thereby preventing downward pressure to the lever 240. For example, when a person 65 stops applying pressure to the button 210 the button spring 290 would push the button 210 back to its default up position allowing lever 240 to return to its default up position thereby causing the gas shut-off valve 230 to close land prevent gas flow through the passage 160. Thus, a child that applies intermittent pressure to the button 210 would not cause continuous gas flow along passage 160. Specifically, the dual, requirement for applying downward pressure to the button 210 while simultaneously, or nearly simultaneously, turning the knob 190 renders the shut-off device 50 resistant to inadvertent or accidental tampering by, for example, a child (not shown).

Still referring to FIGS. 2A, 2B and 2C, continuous gas flow along passage 160 is only possible if the button 210 is held down and the timer knob 190 rotated, and thereby the timer cup 261, from the off position 200 to a position on the face 170 corresponding to a desired cooking time. Holding the button 210 down causes the second opposite end 260 of the lever bar 240 tog move downwards out of the notch 265, then the timer knob 190 is rotated causing the timer cup 261 to rotate, the end 260 of the lever bar 230 is held in a down position by the rim 264 until the inverted cup returns to its original position. While holding down the button 210 the knob 190 is turned by the user 65 from the off position 200 to the desired amount of cooking time as indicated by the time indicia 180 on the timer face 170. When knob 190 is moved to a cooking time, it slowly returns to the off position 200 by action of the spring (not shown) in the spring housing 175. Spring driven timer mechanisms are well known in the clock art and need not be described further here.

It should be understood that the exact arrangement of the component members of the timer-lever control mechanism 195 may vary. For example, in an alternative embodiment, the timer knob 190 remains essentially at a fixed position, and the timer face 170 is rotated relative to the fixed timer knob 190. In this embodiment the timer face 170 (and not the timer knob 190) is coupled to the axis 192, which rotates (along with the attached timer cup 261) in unison with the timer face 170 such that as the timer face 170 slowly returns to its default position, wherein the off label 200 aligns with the timer knob 190, the timer cup 261 also returns to its original position such that the notch 265, aligns with the lever end 260 which under the bias of spring 280 re-occupies the notch 265 and in turn closing the lever operated shut-off gas valve 230 thereby stopping gas flow along passage 160 between the gas inlet port 120 and gas outlet port 130.

Referring generally to FIGS. 3A and 3B that show a further embodiment of the invention, a timer-lever control mechanism 195 is operably connected to the lever 240*b* having a first end 250*b* and a second opposite end 260*b*, respectively, defining a middle section 270*b*, wherein the timer-lever control mechanism 195 is adapted to allow a user 65 to input a predetermined time interval, wherein the timer-lever control mechanism 195 is operably connected to the second end 260*b* of the lever 240*b*, and wherein the timer-lever control mechanism 195 is adapted to control the up and down status of the lever 240*b*. A button 210*b* is operably connected to the lever 240*b*, wherein the button 210*b* has a default down position and in response to a force can be moved to a non-default position. Continuous gas flow (shown by arrows 282) along the passage 160 is possible if a predetermined time interval is entered into the timer-lever control mechanism 195 (FIG. 4A) while the button 210*b* is held in the non-default position to provide the tamper resistant, safety promoting, and gas saving gas shut-off device 50.

Referring to FIGS. 3A and 3B in more detail, FIG. 3A is a top view of the gas shut-off device 50 in which the optional gash pressure gauge 220 is located downstream of the lever operated, gas shut-off valve 230*b*, button 210*b* and the timer-lever control mechanism 195. FIG. 3B shows an interior view of the gas shut-off device 50 of FIG. 3A. In this embodiment the button 210*b* and the gas shut-off valve 230*b* operate in reverse with respect to the gas shut-off valve 230 shown in FIGS. 2A and 2B. Specifically, if the lever bar 240*b* is in an up position, the shut-off valve 230*b* is open, and when the lever bar 240*b* is in a down position the valve 230*b* is closed. In this embodiment the lever 240*b* is biased to maintain a down position by spring member 280*b*.

Referring to FIG. 3B in particular, the button 210*b* is biased to adopt a default down position by spring member 290*b* located inside the housing 110; the spring member 290*b* is caused to abut against the interior of the housing 110 by button member 210*b*. When the button 210*b* is pulled the lever 240*b* moves in unison to an up position. Thus, when the button 210*b* is pulled up the lever 240*b* moves to an up position and in response the shut-off gas valve 230*b* opens and gas can flow through the passage 160.

More specifically, if the button 210*b* is pulled the lever and the timer knob 190 is rotated from the off position 200, the lever end 260*b* is moved out of the notch 265 in the cup 261 (shown in a non-inverted orientation in FIG. 3B) and the cup 261 rotates in unison with the time knob from the off position 200. The gas valve 230*b* remains open and gas can flow along the passage 160 while the lever end 260*b* is not in the notch 265. The knob 190 and cup 261 rotate in unison slowly back to the off position 200 by action of the timer spring in the spring housing 175. Once the cup 261 is returned to the off-position 200 the lever end 260*b* snaps back into the notch 265 in response to spring 280*b* and the gas cut-off valve immediately closes stopping gas flow along the passage 160.

With respect to FIGS. 4A, 4B, and 4C, FIG. 4A shows the timer-lever control mechanism 195. The timer-lever control mechanism 195 comprises the timer knob 190, timer face 170, axle 192, timer spring mechanism 175, and cup 261. Mechanical spring driven timers are well known in the clock art and are not discussed further here. The cup 261 is shown in FIG. 2B in an inverted orientation, but can be used in a non-inverted orientation as shown in FIG. 3B. The timer cup 261 has a disc 262 with a circumference 263 and a rim 264 developed from the circumference 263. The center of the disc 262 defines a through-hole 275 with an optional hollow tube 277 developed therefrom connected to axle 192 such that if the axle 192 rotates, the timer cup 261 rotates in unison. The rim 264 includes an indentation shown as a notch 265 as shown in FIG. 4B. It should be understood that the form of connection between the timer cup 261 and the axle member 192 of the timer-lever control mechanism 195 may vary without detracting from the spirit and scope of the invention, as defined by the appended claims.

The gas shut-off valve 50 may be retrofitted to a gas fueled appliance such as the grill 60. For example, a purchaser may buy the gas shut-off valve 50 from a retailer and then fit the gas shut-off valve 50 of the invention to a grill 60. Similarly, a commercial gas fitter may retrofit a gas appliance, and a manufacturer may fit the gas shut-off valve 50 during the assembly of a gas appliance such as the grill 60.

It is to be understood that the present invention is not limited to the embodiments described above, but encompasses any and all embodiments within the scope of the following claims.

I claim:

1. A tamper resistant, safety promoting, and gas saving gas shut-off device to selectively shut off a flow of gas, such as liquid petroleum gas or natural gas, to a gas fueled device such as a BBQ grill in response to a user selected time period, comprising:

a housing having a gas passage with a first opposite end defining a gas inlet port for inputting gas from a gas supply and a second opposite end defining a gas outlet port;

a lever operated gas shut-off valve having an open position and a closed position and located between the gas inlet and gas outlet;

a lever operably connected to the lever controlled gas shut-off valve, the lever having a lever-up and a lever-down position for controlling the open and closing of the lever operated gas shut-off valve, wherein the lever has a first end, a middle section and a second opposite end, and wherein the first end of the lever is operably connected to the lever controlled gas shut-off valve;

a timer-lever control mechanism operably connected to the lever, wherein the timer-lever control mechanism is adapted to allow a user to input a predetermined time interval, wherein the timer-lever control mechanism is operably connected to the second end of the lever, and wherein the timer-lever control mechanism is adapted to control the up and down status of the lever; and a button operably connected to the middle section of the lever, wherein the button has a default position and in response to a force can be moved to a non-default position;

wherein continuous gas flow along the passage is possible if a predetermined time interval is entered into the timer-lever control mechanism while the button is in the non-default position thereby providing the tamper resistant, safety promoting, and gas saving gas shut-off device.

2. The tamper resistant, safety promoting, and gas saving gas shut-off device of claim 1, wherein the button is biased to return and remain in the button's default position absent a force sufficient to move the button to the non-default position.

3. The tamper resistant, safety promoting, and gas saving gas shut-off device of claim 1, wherein the button's default position is a button up-position and conversely the button's non-default position is a button down-position.

4. The tamper resistant, safety promoting, and gas saving gas shut-off device of claim 1, wherein the button's default position is a button down-position and conversely the button's non-default position is a button up-position.

5. The tamper resistant, safety promoting, and gas saving gas shut-off device of claim 1, wherein when the lever is in the lever-up position the lever operated gas shut-off valve is closed and conversely when the lever is in the lever-down position the lever operated gas shut-off valve is open thereby enabling gas to flow along the passage towards the gas outlet port.

6. The tamper resistant, safety promoting, and gas saving gas shut-off device of claim 1, wherein when the lever is in the lever-down position the lever operated gas shut-off valve is closed and conversely when the lever is in the lever-up position the lever operated gas shut-off valve is open thereby enabling gas to flow along the passage towards the gas outlet port.

7. The tamper resistant, safety promoting, and gas saving gas shut-off-device of claim 1 in combination with a BBQ grill to selectively shut off a flow of gas to the BBQ grill.

8. A tamper resistant, safety promoting, and gas saving gas shut-off device to selectively shut off a flow of gas, such as liquid petroleum gas or natural gas, to a gas fueled device such as a BBQ grill in response to a user selected time period, comprising:

a housing having a gas passage with a first opposite end defining a gas inlet port for inputting gas from a gas supply and a second opposite end defining a gas outlet port;

a lever operated gas shut-off valve having an open position and a closed position and located between the gas inlet and gas outlet;

a lever operably connected to the lever controlled gas shut-off valve, the lever having a lever-up and a lever-down position for controlling the open and closing of the lever operated gas shut-off valve, wherein the lever has a first end and a second opposite end, and wherein the first end of the lever is operably connected to the lever controlled gas shut-off valve;

a timer-lever control mechanism operably connected to the lever, said timer-lever control mechanism includes a timer face, a timer knob, an axle, a cup, and a timer spring mechanism, wherein the timer-lever control mechanism is adapted to allow a user to input a predetermined time interval, wherein the timer-lever control mechanism is operably connected to the second end of the lever, and wherein the timer-lever control mechanism is adapted to control the up and down status of the lever; and a button operably connected to the lever, wherein the button has a default position and in response to a force can be moved to a non-default position;

wherein continuous gas flow along the passage is possible if a predetermined time interval is entered into the timer-lever control mechanism while the button is in the non-default position thereby providing the tamper resistant, safety promoting, and gas saving gas shut-off device.

* * * * *